US005133099A

United States Patent [19]

McBride et al.

[11] Patent Number: 5,133,099

[45] Date of Patent: Jul. 28, 1992

[54] METHOD OF DYEING TUFTED PILE PRODUCTS IN A PREDETERMINED PATTERN

[75] Inventors: Daniel T. McBride, Chesnee, S.C.; Jan V. Christensen, Kolind, Denmark

[73] Assignee: Milliken Denmark A/S, Morke, Denmark

[21] Appl. No.: 702,932

[22] Filed: May 20, 1991

[51] Int. Cl.[5] ..... D06B 11/00; D06B 21/00

[52] U.S. Cl. ..... 8/149.1; 8/483; 26/2 R; 26/25

[58] Field of Search ..... 8/149.1, 158, 483, 932; 28/162, 2 R, 25

[56] References Cited

U.S. PATENT DOCUMENTS

| | | | |
|---|---|---|---|
| 2,785,042 | 3/1957 | Grajeck et al. | 8/149.1 X |
| 4,005,230 | 1/1977 | Fleissner | 8/149.1 X |
| 4,346,503 | 8/1982 | Sando et al. | 8/149.1 X |
| 4,365,968 | 12/1982 | Gregorian et al. | 8/149.1 X |
| 4,384,867 | 5/1983 | Gruber | 8/149.1 X |

*Primary Examiner*—Philip R. Coe

*Attorney, Agent, or Firm*—H. William Petry; Earle R. Marden

[57] ABSTRACT

Method for dyeing a cotton nap fabric or carpet wherein the dyestuffs belong to a group of vat dyestuffs and reactive dyestuffs and are applied to the cotton nap. The product after the application of the dyestuff is treated with a uniform application of a liquid agent from a group of agents which are able to make the selected dyestuff absorbable by cotton.

1 Claim, No Drawings

METHOD OF DYEING TUFTED PILE PRODUCTS IN A PREDETERMINED PATTERN

The present invention relates to a method for dyeing nap products in a predetermined colour pattern, whereby the product is conveyed in the form of a tufted carpet or tufted carpet tiles in a conveying route or path in which the product is first humidified in a humidifying operation, then exposed to a mechanical treatment in a so-called beater bar for erecting the nap before spraying on of liquid dyestuff, from a computer operated multi-nozzle dyeing apparatus having a set of nozzles for each dyestuff, and fixation of the dyestuffs onto and in the nap, and subsequent washing out the non-fixed surplus dyestuffs, if any, and drying of the product thus dyed.

Such method is known for the dyeing of nap products, such mats, carpets, towels, etc. in a predetermined pattern, e.g., from Danish Pat. No. 136.760, corresponding to U.S. Pat. application Nos. 430,454 filed Jan. 3, 1974 and 493,186 filed Jul. 30, 1974, now Pat. No. 4,034,584, wherein a tufted product is dyed in multicoloured patterns by means of dyestuff nozzles dispensing their dyestuff jets to a dyestuff collecting means wherein the dyestuffs are recirculated for reuse in the periods during which the dyestuff nozzles do not dispense their dyestuff jets to the tufted product during the dyeing operation.

Said recirculation of the dyestuffs is necessary, partly for retaining said dyestuffs under optimum application conditions, such as constant viscosity, constant dyestuff content, constant pressure and constant temperature, and partly for retaining a precise dyestuff jet control which would be decreased if the application parameters of the dyestuffs are not kept constant.

Said recirculation of dyestuffs has limited the application of the method to those tufted products, wherein the nap is made of wool or plastics, partly because the applied dyestuffs immediately after having been applied to the nap, efficiently dyed said nap, partly because the dyestuffs applicable to wool and plastics can endure a recirculation without being substantially impaired, and partly because they are suitable for having their application parameters kept constant by means of additives.

If this known method should be used directly on cotton nap for which rather special dyestuffs are required, such as vat dyestuffs or reactive dyestuffs, either said dyestuffs would be destroyed by the recirculation, if the additives necessary for the dyestuffs to be absorbed in the cotton had been added, because said additives are destroyed either by the oxidation during the recirculation, wherein the dyestuff jets entrain atmospheric air, or by their long stay in the recirculation circuit, or the components associated with the nozzles may be damaged by said additives.

In accordance with this method of the invention the nap in the nap product is a cotton nap, all dyestuffs have been selected from one of the dyestuffs belonging to the group of dyestuffs comprising vat dyestuffs and reactive dyestuffs, and that the product after application of the selected dyestuff of at least one colour in a predetermined pattern is caused to pass an applicator which is adapted to perform totally uniform application of a liquid agent, from which applicator the liquid agent is uniformly applied onto the product, said liquid agent being selected from that group of agents, the members of which are able to make said selected dyestuff absorbable by cotton depending on which of the dyestuffs having been selected from said group of dyestuffs, whereupon the product is exposed to a heat treatment for heat fixation of the dyestuffs before said washing out operation. Thereby it becomes possible to achieve a dyeing of cotton nap products in a well defined pattern and with a high degree of colourfastness to rubbing, and which colourfastness is maintained, even after long time use of the cotton products, where said products are subject to several washing processes. This is presumably due to the fact that the additives necessary for cotton dyestuffs to be absorbed in the cotton pile or nap, are applied to the nap in the products after the nap has been provided with the sprayed on dyestuff pattern, but while said dyestuffs are still in their liquid form on and in the nap.

In said overflow applicator the additives are present in their liquid form, and they are dispensed from the applicator over the total width of the product, when the product in its conveying route or path with a constant speed is passed below the liquid dispensing edge of the applicator. The dispensed quantity of liquid additive depends on the conveying speed, on the applied dyestuff concentration, dyestuff and dyestuff quantity, on the contents of active components in the liquid additive and on the viscosity and temperature of the liquid additive.

EXAMPLE 1

A textile web consisting of a basic texture, in which a cotton nap has been tufted, should be provided with a nozzle printed pattern on the cotton nap.

The textile web was exposed to a moistening operation in a foulard or padding machine. The moistening agent was water based and contained a soap, such as a syndet of the anionic active tensides, in the form of 2 g/l Invadin LU® from Ciba-Geigy. The observed wet pick-up was about 80–100%. The tufted product had a basic texture consisting of 100% spun-bonded polyester PES having an area weight of 120 g/m$^2$. In the basic texture was tufted a nap of 1040 g/m$^2$ boiled off cotton type Ne 8/6, the nap height was 13 mm and the distance between the tuft rows was 3.9 mm.

Upon foulardization, i.e., padding over, wherein the nap was squeezed together, the nap was beaten up in a beater bar so that the nap was re-erected.

Thereupon the nap product on the conveying route was fed into a multi-nozzle dyeing apparatus of the make Millitron®, wherein the dyestuffs were recirculated when not controlled to the nozzles to hit the tufted product. The applied dyestuffs were vat dyestuffs, Class CII/(CIII), Ciba-Geigy's notation or corresponding BASF notation IW/IK for cold dyeing. To reduce the solubility of the dyestuff flot in water and its tendency to bleeding, was added 20 g/l, preferably at most 40 g/l $Na_2SO_4$, Glauber salt, and for further prevention of bleeding a migration inhibitor was added, e.g., Irgapadol MP®, which is a polyacryl acid derivate from Ciba-Geigy. Furthermore, a water softening agent was added, 0.75 g/l Calfort® from Hoechst, and an anti-foam agent 1.0 g/l ISN from Bodotex. A wet pickup of about 240–260, preferably 250%, was achieved, and the viscosity of the vat dyestuffs was in the area 250–350 cps, 400 cps at the most.

Examples of applicable vat dyestuff recipes are:

| | |
|---|---|
| Grey colour: | 5 g/l grey P2R (Cibanon), vat black 22 |
| Blue colour: | 0.7 g/l red FBB (Indanthren), vat red 10 and |

-continued

| | |
|---|---|
| | 9.8 g/l blue CLF (Indanthren), vat blue 66 |
| Brown colour: | 30 g/l brown BR (Cibanon), vat brown 1 |
| Red colour: | 6.4 g/l red FBB (Indanthren), vat red 10 and 0.5 g/l yellow 3R (Cibanon), vat blue 66 |
| Yellow Colour: | 5 g/l yellow 3R (Cibanon), vat orange 11 |
| Wine Red Colour: | 5 g/l red FBB (Indanthren), vat orange 11, and 0.5 g/l blue CLF (Indanthren), vat blue 66 |

After application of vat flot onto the tufted product said product was passed below an overflow applicator dispensing over the total width of the product a mixture of soda lye and a reduction agent onto the applied vat flot for rendering the applied dyestuff water soluble, so that it gets affinity to cotton. A mixture of 40 g/l NaOH and 80 g/l sodium dithionite $Na_2SO_4$ as a reduction agent was used. The pH value was 13–14.

From the overflow applicator the product was passed on to the heat fixation of the dyestuffs by means of steam in a so-called steamer at about 100° C. under the most possible absence of atmospheric air. Thereby a vatting of the dyestuffs takes place, whereupon they are oxidized back by means of the atmospheric air to their water-insoluble form for achieving a high degree of colourfastness to rubbing and washing for the product.

A removal of possible atmospheric air, which will otherwise decompose the sodium dithionite in the steamer, may take place before introducing the product into the steamer by adding or spraying the sodium dithionite therein, whereby said extra addition uses up the oxygen in the steamer, before the product is introduced therein. Possibly the steamer may be exposed to an overpressure for further preventing the entering of atmospheric air.

From the fixation operation the product was passed on to a washing operation for washing out the non-vatted dyestuffs by means of cold water which in its atomized form was sprayed on and subsequently squeezed out by means of rollers, until the pH value of the washing water has dropped till below 8. The washing water was added citric acid for neutralizing the lye in the product.

After the washing out operation the product was dried during simultaneous sucking, whereupon the product was taken through a heat washer and a sucking means with a subsequent second drying.

EXAMPLE 2

One textile web was treated as in Example 1 including the treatment in the multi-nozzle dyeing apparatus. Instead of vat dyestuffs was used reactive dyestuffs, here of the type for the pad steam method, but the latter is no condition. Furthermore, a water softening agent was added: 0.75 g/l Calfort® from Hoechst, and an anti-foam agent 1.0 g/l ISN from Bodotex. A wet pick-up of about 240–260, preferably 250% was achieved, and the viscosity of the reactive dyestuffs was in the range of 250–350 cps, preferably 400 cps at the most.

As reactive dyestuffs may as examples be applied one or more of the following ICI® dyestuffs:

| | |
|---|---|
| ICI Procion | yellow MX-8b, CI No. yellow 86 |
| ICI Procion | orange MX-2R, CI No. orange 4 |
| | Red MX-5B, CI No. red 2 |
| | Blue MX-2b, CI No. blue 109 |
| | Blue MX-G, CI No. blue 163 |

After application of reactive flot to the tufted product said product was passed below an overflow applicator, which uniformly all over the width of the product dispensed a mixture of 20–250 g/l soda lye NaOH and a salt $Na_2SO_4$, 50 g/l NaOH or preferably NaCl, 50 g/l NaOH, to the reactive flot for preparing the cotton for reaction with the dyestuff in the steamer, the concentration of the soda lye, NaOH, being determined by the selected reactive dyestuffs and by the quantity reactive dyestuff absorbed in the textile web.

From the overflow applicator the product was passed on to heat fixation of the dyestuffs in steam in a so-called steamer at about 100° C. and by the most possible absence of atmospheric air.

From the fixation operation the product was passed on to a washing operation for the washing out of surplus dyestuffs by means of cold water, which was atomized via spray bars onto the upper and lower side of the product, which then was taken through a washer in the form of a drum, whereby the water supplied to the drum passes through the drum, the surface of which was provided with openings for this purpose, and thereby through the nap until the Ph value of the washing water was decreased to a value below 8. To the washing water was added citric acid for neutralization of the lye in the product.

After the washing out operation the product was treated in the same way as in Example 1.

It must be observed that the term fixation with regard to vat dyestuffs means a physical fixation whereby the dyestuffs or pigments so to speak after their migration into the fibres by oxidation are locked up within the fibres into which they have penetrated after the vatting and during their migration, whereas the term with respect to reactive dyestuffs means a chemical fixation, whereby the dyestuffs after their migration into the fibres are chemically bonded by a chemical reaction within the fibres into which the dyestuffs have penetrated.

I claim:

1. Method for dyeing tufted carpet or carpet tiles with upstanding nap surfaces by carrying the carpet or carpet tile in a path wherein the upstanding nap surfaces are dyed comprising the steps of: humidifying the carpet or carpet tile, erecting the nap of the carpet or carpet tile after humidification by the action of a beater bar thereon, after erection of the nap spraying liquid dyestuff thereon from a computer operated multi-nozzle dyeing apparatus having a set of nozzles for each dyestuff, heat treating the carpet or carpet tile after the application of the liquid dyestuff to provide heat fixation of the dyestuffs on the nap, washing out the non-fixed surplus dyestuffs after heat fixation and drying the washed out dyed carpet or carpet tile, wherein the nap in the nap product is a cotton nap, all dyestuffs have been selected from one of the dyestuffs belonging to the group of dyestuffs comprising vat dyestuffs and reactive dyestuffs, and that the product after application of the selected dyestuff of at least one colour in a predetermined pattern is caused to pass an applicator which is adapted to perform totally uniform application of a liquid agent, from which applicator the liquid agent is uniformly applied onto the product, said liquid agent being selected from that group of agents, the members of which are able to make said selected dyestuff absorbable by cotton depending on which the dyestuffs having been selected from said group of dyestuffs.

* * * * *